US005138852A

United States Patent [19]

Corcoran

[11] Patent Number: 5,138,852

[45] Date of Patent: Aug. 18, 1992

[54] TRIPLE LOCK HANDCUFF WITH CUSHION GRIP

[76] Inventor: Dan E. Corcoran, 8310 S.W. Greenway, No. 45, Beaverton, Oreg. 97005

[21] Appl. No.: 708,220

[22] Filed: May 31, 1991

[51] Int. Cl.[5] ..... E05B 75/00

[52] U.S. Cl. ..... 70/16

[58] Field of Search ..... 70/16, 17, 15; 119/127, 119/128; 128/882; 446/26

[56] References Cited

U.S. PATENT DOCUMENTS

| | | | |
|---|---|---|---|
| 240,121 | 4/1881 | Gustaveson | 119/128 |
| 1,038,492 | 9/1912 | Lorey | 70/16 |
| 1,454,546 | 5/1923 | Landis | 70/15 |
| 1,775,727 | 9/1930 | Latou | 70/16 |
| 1,855,687 | 4/1932 | Neal | 70/16 |
| 3,027,895 | 4/1962 | Williams . | |
| 3,042,032 | 7/1962 | Vogel | 128/882 |
| 4,186,688 | 2/1980 | Gaitan | 119/128 |
| 4,314,466 | 2/1982 | Harris . | |
| 4,526,165 | 7/1985 | Mielnik, Jr. et al. . | |
| 4,574,600 | 3/1986 | Moffett . | |
| 4,694,666 | 9/1983 | Belllingham et al. . | |
| 4,910,831 | 3/1990 | Bingold | 70/16 |

*Primary Examiner*—Renee S. Luebke
*Assistant Examiner*—D. Boucher
*Attorney, Agent, or Firm*—Chernoff, Vilhauer, McClung & Stenzel

[57] ABSTRACT

A triple-lock handcuff of the type having a blade pivotally joined to spaced-apart cheek plates for movement through a locking channel includes several improvements. The lock assembly includes first and second pawl members resiliently urged toward the channel independently of one another by separate springs. A key operated extractor block carries a yoke for moving both pawl members simultaneously away from the channel to open the handcuff. The first and second pawl members are spaced-apart within the locking channel. An elongate resilient cushion is arranged along the inner edge of the blade so as to assume a first unloaded profile capable of passing between the cheek plates and, alternately, a second profile when bearing upon a limb, incapable of passing between the cheek plates. A sleeve detachably fastens the cushion to the blade's inner edge while leaving the blade's outer edge free of overlay. When the cushion is loaded, the sleeve locks the cushion on the edge of the blade by urging a pair of opposed feet into grooves formed in the side of the blade.

33 Claims, 5 Drawing Sheets

TRIPLE LOCK HANDCUFF WITH CUSHION GRIP

BACKGROUND OF THE INVENTION

The present invention relates to handcuffs, and in particular, to a handcuff having improved security against tampering and providing a secure yet humane grip.

In police work, a type of handcuff known as a "speed cuff" is often used. This type of handcuff is shown, for example, in FIG. 1 of Harris, U.S. Pat. No. 4,314,466 and can be applied by a single officer to the wrist of a suspect. As shown in Harris, such a handcuff includes a casing for a lock assembly, a pair of spaced-apart arcuate cheek plates connected to a corner of the casing, and an arcuate blade pivotably connected to the outer ends of the cheek plates for full 360° rotation between the cheek plates. In operation, the outward edge of the blade is typically brought, in rapid movement, against the wrist of the suspect, causing the blade to flip completely around the pivot so that the inward edge of the blade, in cooperation with the inward edge of the cheek plates, encircles the wrist of the suspect.

In a conventional speed cuff, as shown in FIG. 1 of Harris, the casing defines an upper channel through which the blade passes. A set of teeth on the outer edge of the blade interacts with an opposing set of teeth on a resiliently biased pivoting pawl member which is part of the lock assembly. Reverse or opening-type movement of the blade is prevented by latched interaction between the blade and pawl member, while forward or closing-type movement of the arm freely occurs, thus permitting the handcuff to close irreversibly about the subject's limb. During forward movement of the blade, the resiliently supported pawl member drifts into and away from the channel as it rides on the teeth of the blade. To unlock the handcuff for release of the subject's limb, an external key is employed, a tang on the key engaging a catch that pivots the resiliently supported pawl member away from the blade.

Alternative types of handcuffs, as shown in Moffett, U.S. Pat. No. 4,574,600 and Bellingham, et al., U.S. Pat. No. 4,694,666, bias the pivoting pawl member with a folded-over leaf spring rather than the capped spring of Harris.

In police work, it is essential that the handcuff be secure against tampering, both to protect the custodial officer and innocent bystanders. One method often used to "pick" a handcuff lock is to force a shim or bent paper clip into the channel between the pawl member and the blade so as to permit the blade to be backed out of the channel. Another tampering method may be described as "cracking," wherein the lock casing is struck against a hard surface while tension is applied to the blade. If the casing is properly struck, the inertia of the pawl member momentarily overcomes the bias of the spring, allowing the handcuff to snap open.

Heretofore, the principal mechanism used to safeguard against tampering has been a "deadbolt" slide which is slid into a wedged position behind the pawl member so that the pawl member can be immobilized, in a "double-locked" or deadlocked position, with its teeth interlockably engaging the teeth of the blade. Such a deadbolt has not proven to be entirely satisfactory. With some locks, for example, it is a simple matter to "crack" the lock in one direction, so that the deadbolt shifts away from its locked position, before cracking the lock a second time to open the handcuff. In many locks, a key is required to shift the deadbolt to its wedged position, but, in a practical arrest situation where, for example, it is dark and there are several excited and armed suspects afoot, an officer may have little opportunity to grope about for the proper key. With other locks, such as those of Bellingham, et al. and Harris, the deadbolt is easily shifted to its wedged position by, for example, a hand-pull knob or an automatic wrist catch. However, if the deadbolt is activated prematurely, either inadvertently by the officer or intentionally by the suspect, the blade of the handcuff can be locked against movement, either forward or rearward, so that the handcuff is effectively rendered useless until the officer can locate the proper key and return the deadbolt to its ready condition.

In addition to problems with lock tampering, another concern with existing handcuffs is the difficulty of obtaining a satisfactory gripping force. In part this is due to the individual differences that exist in wrist size and shape. Representing one extreme, for example, are suspects whose limbs are emaciated through drug abuse, poor nutrition and disease, while at the other extreme are heavy-built suspects with beefy limbs. Moreover, there are gender-related differences in the shape of the wrist. To partially compensate for these differences, some officers use two or more sizes of handcuffs, but this increases the weight of equipment that the officer must carry while on duty and, insofar as more keys are required, adds to the time spent looking for the proper key.

Apart from individual differences in wrist size and shape it is difficult to precisely adjust the tightness with which the handcuff grips the suspect's wrist. On the one hand, if the handcuff is set too loose, the suspect may be able to quietly work his hand free and pose a significant danger to the unalerted officer. On the other hand, if the handcuff is set too tight, the blade of the handcuff can abrade and cut into the suspect's skin, or cut off blood circulation causing temporary loss of sensation or even permanent limb injury.

In the medical field the need for restraining the limbs of a patient in a non-injurious manner have led to the use of cushioned pads which are mounted on the inside surface of a broad encircling strap. Such devices are shown, for example, in Mielnik, Jr., et al., U.S. Pat. No. 4,526,165, and Williams, U.S. Pat. No. 3,027,895. For police work, however, these devices have not appeared suitable, since such pads would interfere with the normal interleaving movement of the blade and cheek plates that occurs during operation of a speed cuff. Furthermore, it would be relatively easy, with these devices, for a suspect to release himself or herself by, for example, separating the cushioning portion from the restraining portion.

A further problem that has received more recent recognition is the difficulty of properly sanitizing handcuffs. In particular arrest situations, the handcuff may become contaminated with body fluids, such as sweat, vomit, or blood, and certain types of infections, such as AIDS and hepatitis, may survive on the handcuff long enough to be acquired by others through abrasions or cuts. Efforts to sanitize the handcuff after use are therefore desirable. However, standard sterilization procedures, such as autoclaving, may rust the locking mechanism of the handcuff, and informal methods, such a quick wipe by an alcohol-impregnated towel, are not entirely reliable for removing contagions.

Accordingly, it is an object of the present invention to provide a handcuff having improved resistance to tampering.

A related object of the present invention is to provide a handcuff offering the above-identified advantage while remaining in a ready-to-use condition.

Another object of the present invention is to provide a handcuff that operates in a familiar manner for those who are accustomed to operating conventional handcuffs.

Yet another object of the present invention is to provide a tamper-proof speed cuff that, each time it operates, will grip the wrists of a subject securely yet without causing injury.

Still a further object of the present invention is to provide a single handcuff adaptable to large- and small-wristed persons alike.

A related object of the present invention is to provide a speed cuff which more than doubles the gripping contact between the cuff and the limb of the subject.

Yet an additional object of the present invention is to provide a handcuff that is readily sanitized to a level where the risk of spreading infections by use of the handcuff is negligible.

SUMMARY OF THE PRESENT INVENTION

In achieving the aforementioned objects, the handcuff according to the present invention includes first and second pawl members, each pawl member including a finger that extends into the channel of the casing. Operatively associated with each pawl member is a locking mechanism that resiliently urges the pawl member toward the channel and yieldably permits movement of the pawl member away from the channel. In particular, the operation of the locking mechanism is such that the respective pawl members are movable toward and away from the channel independently of one another.

Desirably, the fingers of the first and second pawl members are spaced-apart from each other in the channel, with one proximate the entrance of the channel and the other proximate the exit. This configuration increases the resistance of the lock to picking, for without having the benefit of free movement of his or her hands, the suspect will have difficulty in performing the deft manipulations that are needed to pick the lock at two separate locations simultaneously. As an added advantage, the operative range of the handcuff is greatly increased so that, for example, the handcuff will lock about a relatively small wrist even after the teeth of the blade have entirely passed by the finger of the leading pawl member.

Another aspect of the invention is the combination of a speed cuff and cushion, the cushion being arranged along the inner edges of the blade and one or both of the cheek plates. The cushion on the blade is so dimensioned as to, in cross-section, alternately assume a narrow profile for passing through the gap between the cheek plates of the speed cuff, and a wide profile when bearing upon a subject's limb incapable of passing through such gap. The cushion includes a resilient component that causes the cushion to resume its narrow profile after being removed from the suspect's wrist. Such a cuff can, without injury or undue discomfort to the suspect, be sufficiently tightened by an officer as to make it highly improbable that the suspect will be able to work his hands free. Use of such a cushion increases the gripping surface between the cuff and the subject's limb.

A related aspect of the present invention is a fastening sleeve capable of detachably holding the cushion to the inner edges of the blade and/or cheek plates while leaving the outer edges of the blade and cheek plates free of overlay. In the preferred embodiment, for example, the fastener is an elongate, semiflexible sleeve having a generally H-shaped cross-section, the lower legs of the H sitting flush with the sides of the blade and cheek plates.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
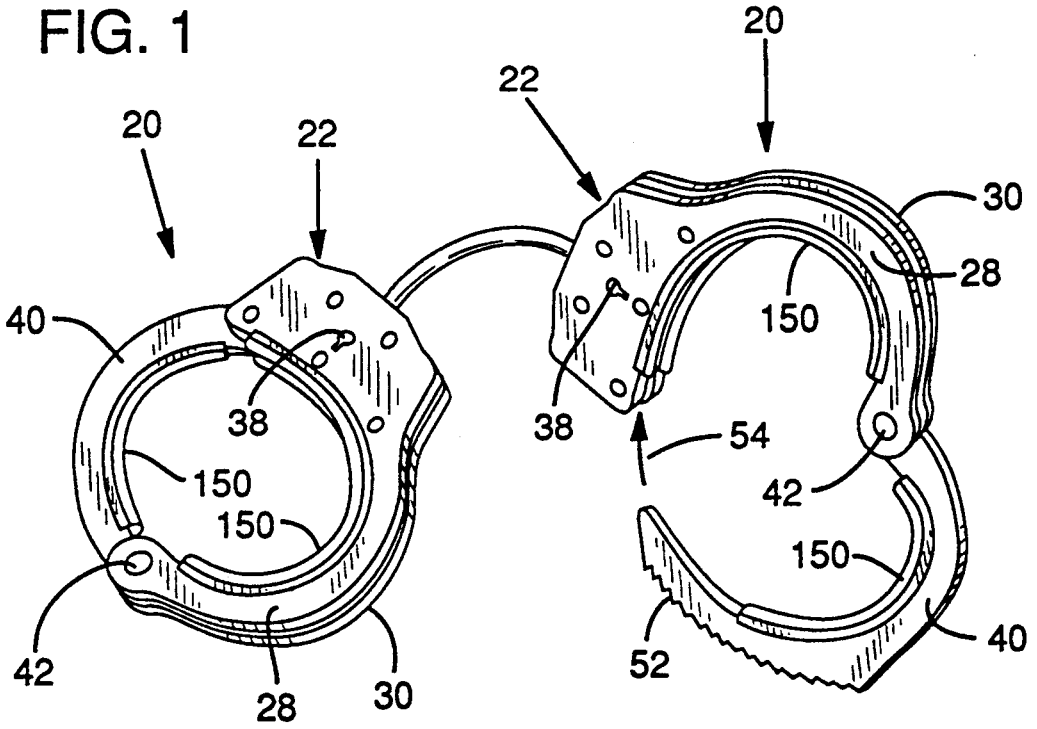
FIG. 1 is a perspective view of a joined and matching pair of exemplary handcuffs, in accordance with the present invention.

FIG. 1 shows a matching pair of exemplary triple-lock handcuffs with cushion grip 20 constructed in accordance with the present invention. Each exemplary handcuff 20 includes a casing 22, a pair of arcuate spaced-apart cheek plates 28 and 30 connected to the casing, and an arcuate blade 40 connected by a pivot 42 to the cheek plates and traversable through a channel 54 defined by the casing. A cushion 150 is arranged along the inner edges of the blade and cheek plates.

Figure 2:
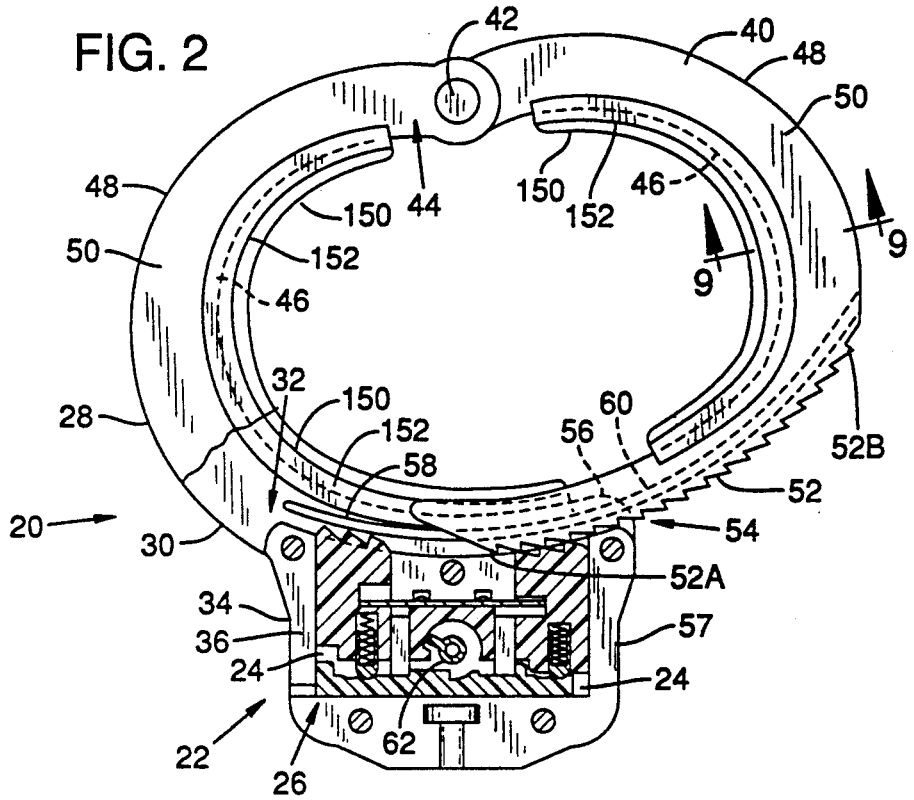
FIG. 2 is an elevational view of an exemplary handcuff of FIG. 1, configured for holding a large-sized wrist, with portions of the casing and a cheek plate removed to clearly show the exemplary lock assembly.
Figure 3:
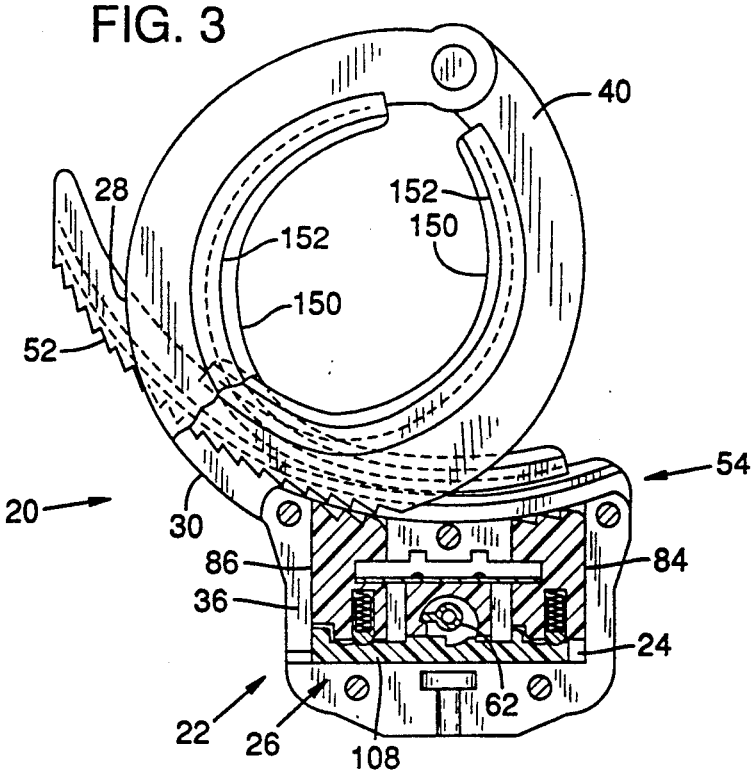
FIG. 3 is similar to FIG. 2, except that the handcuff is configured for holding a small-sized wrist.

Referring to FIG. 2, the inner ends 32 of both cheek plates 28 and 30 are fixedly attached to the left edge 34 of the casing 22. The outer ends 44 of the cheek plates pivotally mount the blade 40 so that the blade can freely rotate 360° around the outer ends 44 of the cheek plates and between the cheek plates. The blade and cheek plates each have a generally concave inner edge 46, a generally convex outer edge 48, and a pair of spaced-apart sides 50 (only the forwardmost sides being visible). A series of slanted teeth 52 are formed on the outer edge of the blade 40 opposite the pivot 42. The teeth of the blade move through an elongate channel 54 that is defined by the upper edge 56 of the casing and extends generally from the left edge 34 of the casing to the right edge 57. During movement of the blade through the channel 54, an elongate arcuate ridge 58, formed on the rearwardmost half 36 of the casing, engages a curved slot 60 formed in the adjacent side of the blade 40.

Other conventional aspects of the exemplary handcuff 20 include a keyhole 38 (FIG. 1) which is defined in the faceplate of the casing and which is suitably sized for receiving the primary key 62 of the handcuff, as indicated in sectional view in FIG. 2.

During operation, the above-identified elements of the exemplary handcuff 20 operate in a manner conventional for a speed cuff insofar as movement of the outer edge 48 of the blade against the wrist of a suspect causes the blade to flip completely around the pivot 42 so that its inner edge 46, in cooperation with the inner edges of the cheek plates, encircles the wrist. As with a handcuff of conventional design, ratchet-type engagement between a lock assembly 26 and the blade teeth 52 allows forward movement of the blade for tightening of the handcuff about the wrist while reverse movement of the blade is only permitted after the handcuff has been unlocked by operation of the primary key 62.

Figure 4:
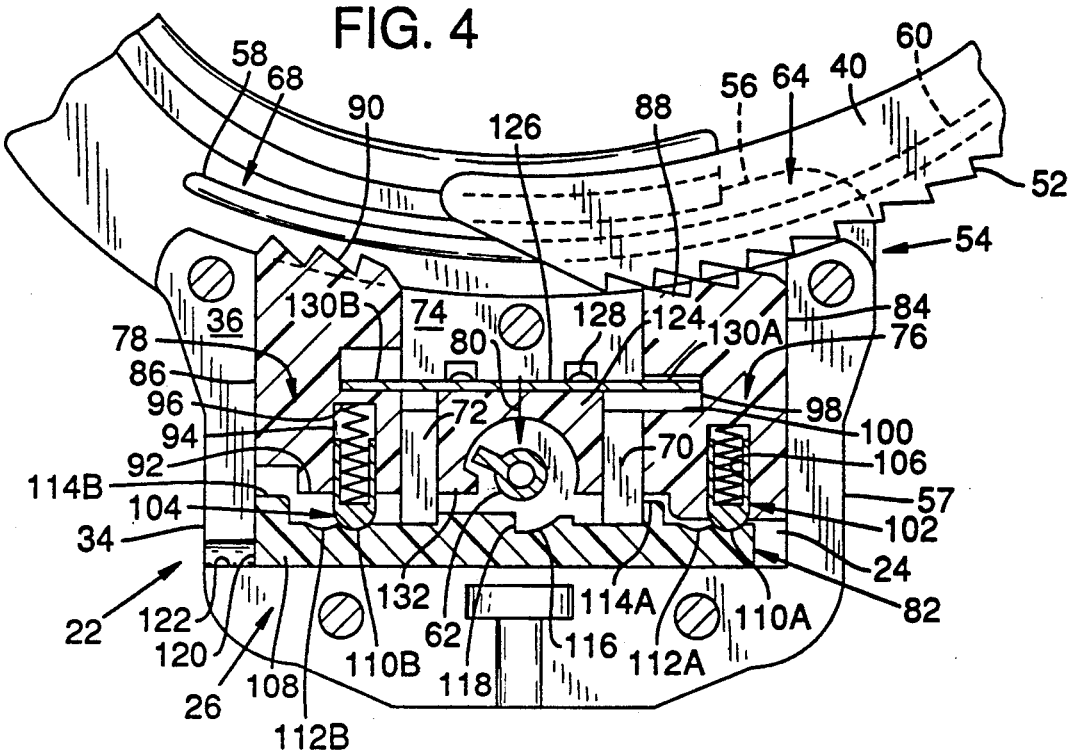
FIG. 4 is an enlarged view of the exemplary lock assembly of FIG. 2.

Referring now to FIG. 4, an enlarged view of the exemplary locking assembly 26 of FIG. 2 is shown in accordance with the present invention. The casing 22 defines a well 24 enclosing the locking assembly. Right and left guideposts 70 and 72, and a central rest 74, rise in relief from the backside of the casing, so as to subdivide the well 24 into right and left chambers 76 and 78, a central chamber 80, and a bottom chamber 82.

The right and left chamber 76 and 78, both open to the channel 54 and extend, respectively, alongside the right and left edges 34 and 57 of the casing 22. Slidably disposed in the right and left chambers are, respectively, right and left pawl members or plungers 84 and 86. The upper end of each plunger defines an array of slanted fingers 88 and 90, respectively, suitable for establishing ratchet-type engagement with the opposite slanted teeth 52 of the blade 40. The channel 54 includes an entrance 64 proximate the right chamber and an exit 68 proximate the left chamber where the blade respectively enters and leaves the channel. The fingers of the right and left plunger extend into, respectively, the entrance and exit of the channel. Each plunger has a stepped lower end 92 in which is defined a cavity 94 defining an inner wall 96. The central portion of each plunger defines a recess 98 that opens toward the central chamber 80 and includes a lower loading surface 100.

In order to resiliently urge right and left plungers, 84 and 86, independently toward the channel 54 yet permit independent movement of such plungers away from the channel, a spring locking mechanism is used in the exemplary embodiment comprising separate right and left spring elements 102 and 104. Each spring element includes a hollow bullet-shaped cap 106 received, tip end out, in the cavity 94 of a respective plunger, with a spring seated inside the cap 106 and bearing against the inner wall 96 of the cavity 94. Desirably, the springs of the right and left spring elements 102 and 104 have relatively different spring constants.

Figure 6:
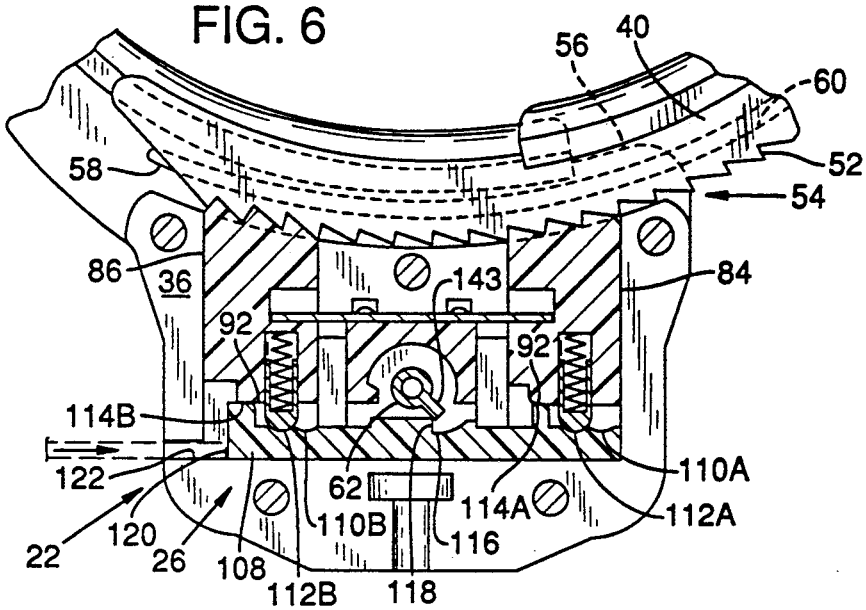
FIG. 6 is similar to FIG. 4, except that the triple-locked state of the exemplary lock assembly is shown.

Disposed in the bottom chamber 82 is an elongate slide 108. As shown in FIG. 4, the upper edge of the slide 108 defines a first pair of notches 110A and 110B spaced sufficiently apart for simultaneous seating of the caps 106 of the right and left spring elements 102 and 104. The upper edge of the slide also defines a second pair of notches 112A and 112B also spaced sufficiently apart for simultaneously seating of the caps when the slide is in the position shown in FIG. 6. A spaced-apart pair of raised shoulders 114A and 114B extend from the upper edge of the slide into, respectively, the right and left chambers 76 and 78 for selective abutment with, as shown by FIGS. 4 and 6 together, the stepped lower ends 92 of, respectively, the right and left plungers 84 and 86. Centrally defined in the upper edge of the slide is a dip 116 bordered by a sheer edge 118. The elongate slide 108 includes a driving end 120 which communicates with the left edge 34 of the casing through a passage 122.

Movably positioned in the closed-off central chamber 80 is an unlocking mechanism comprising an extractor block 124 slidably disposed for up and down movement between the right and left guideposts 70 and 72 and carrying a rigid elongate laterally extending strip or yoke 126. For the preferred embodiment shown in FIG. 4, the yoke is joined to the extractor block by a pair of screws 128. The ends 130A and 130B of the yoke 126 extend into the recesses 98 of the respective plungers 84 or 86. The lower portion of the extractor block includes an overhanging catch 132.

The handcuff 20 of the present invention can be constructed using a metal injection molding process or drop forging. To reduce the weight of the handcuff, however, preferably a lighter material is used such as ZYTEL TM ST 801 made by E.I. duPont deNemours. ZYTEL TM ST 801 is a glass-filled (stiffened) super-tough nylon material. Alternatively, a glass-filled polycarbonate or other lightweight polymeric material can be used as the molding material. For added lubrication and to prevent wear, a TEFLON TM additive of presently known composition can be used in the molding material of the moveable lock components. Some of the components, such as the springs, the spring caps 106, and the yoke 126, and the rivets 38 are preferably formed of metal.

Referring now to FIGS. 2 and 4 together, during operation of the exemplary handcuff 20, as the blade 40 is moved into the channel 54, the fingers 88 of the right plunger 84 alternately drift toward and away from the channel as they ride upon the teeth 52 of the blade. Initially, the left plunger 86 does not follow the movement of the right plunger 84 but, instead, is held steady, with its fingers 90 projecting into the channel, due to the upward force exerted on the left plunger by the second spring element 104. The yoke 126, extending into the recess 98 in the left plunger, limits the extension of the fingers into the channel.

If the wrist of the suspect is very large, the blade 40 will advance only far enough to engage the right plunger 84. In this instance, after the blade has been closed as tightly as desired around the wrist, the blade is released and the teeth 52 of the blade will settle, from their loosely engaged position shown in FIG. 4, into a right single-locked position 138, in close engagement with the fingers 88 of the right plunger 84, as represented in alternately dashed- and dotted-line view in FIG. 5. Since the right spring element 102 urges the fingers 88 of the right plunger 84 into the channel 54, reverse movement of the blade 40 out of the channel is prevented.

Figure 5:
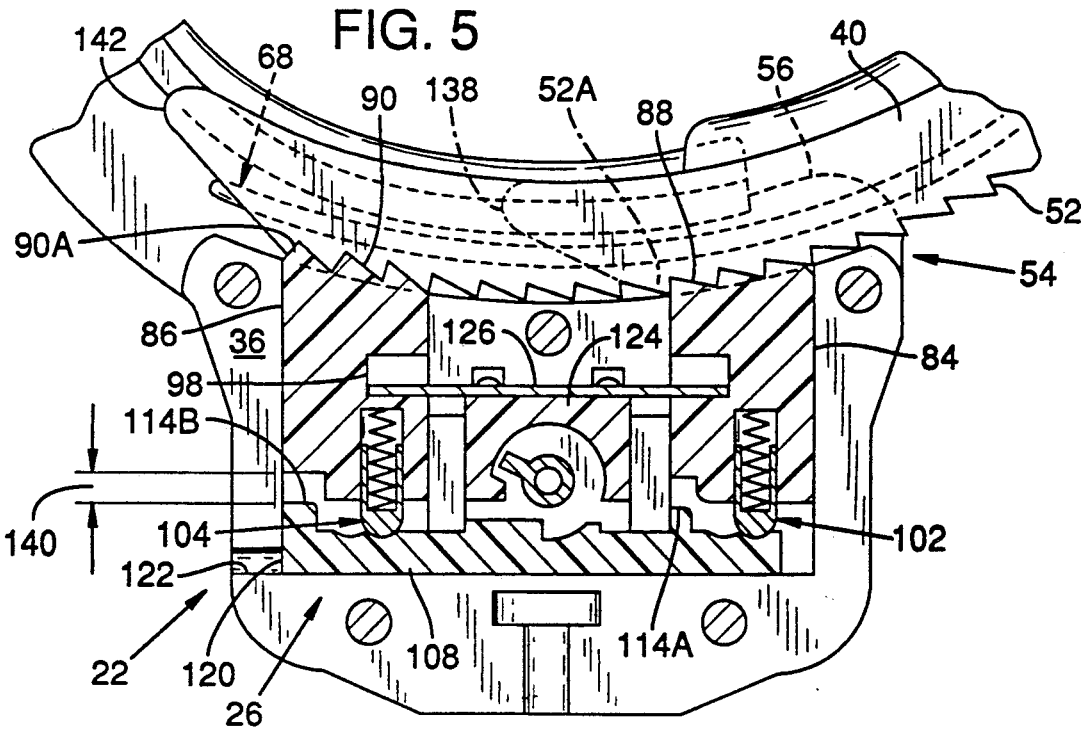
FIG. 5 is similar to FIG. 4, except that the right single-locked state of the exemplary lock assembly is shown in alternately dashed- and dotted-line view and the double-locked state is shown in solid-line view.

In the right single-locked position 138, as shown in FIG. 5, the suspect may be able to maneuver a shim or other such object into the exit 68 of the channel 54 and depress the left plunger 86 to its fully retracted position. Provided that the depth of the recess 98 exceeds the distance 140 available for retraction of the left plunger, however, such tampering will not succeed in moving the right plunger 84 for releasing of the blade. However, in the single locked position, the locking mechanism of the handcuff is susceptible to being picked by depressing the right plunger.

If the wrist of the suspect is of normal size, the blade 40 will advance sufficiently for simultaneous engagement with both the right plunger 84 and the left plunger 86. The "double-locked" position 142 of the blade, in close engagement with both the fingers 88 and 90 of the right and left plungers 84 and 86, respectively, is represented in solid-line view in FIG. 5. As will be recognized from this figure, if the suspect manages, with his bound hands, to insert a shim between the teeth 52 of the blade 40 and the fingers 88 of the right plunger 84, the fingers 90 of the left plunger 86 will continue to engage the teeth so that the blade remains fast within the channel. Conversely, the lock cannot be picked by a shim inserted only across the fingers 90 of the left plunger 86, because the fingers 88 of the right plunger 84 will continue to hold the blade fast. More fundamentally, the independent action of the right and left spring elements 102 and 104 renders the exemplary lock assembly 26 tamper resistant—as does the loose coupling provided between the respective plungers and the unlocking mechanism including the extractor block 124 and yoke 126.

The different spring constants which are provided by the right and left spring elements 102 and 104, enable the double-locked exemplary lock assembly 26 to resist other forms of tampering as well. For example, if the suspect attempts to crack the lock, by striking the bottom edge of the casing 22 against a hard object while pulling back on the blade, the more lightly- loaded plunger will initially fall away from and then resume its engaged position in the channel 52 before the more heavily-loaded plunger has cleared the channel, so that release of the blade will not occur.

It will be recognized that the described resistance of the exemplary lock assembly 26 to tampering is achieved without the need to preselect this characteristic by a key. Moreover, if the blade 40 is inadvertently moved prematurely to its double-locked position 142, shown in FIG. 5, before the wrist of the subject has been encircled, the blade is free to move completely through the channel 52 and around into proper position about the suspect's wrist. Specifically, it is not necessary that the blade 40 first be immobilized inside the channel 52 before adequate protection against tampering is obtained.

Figure 7:
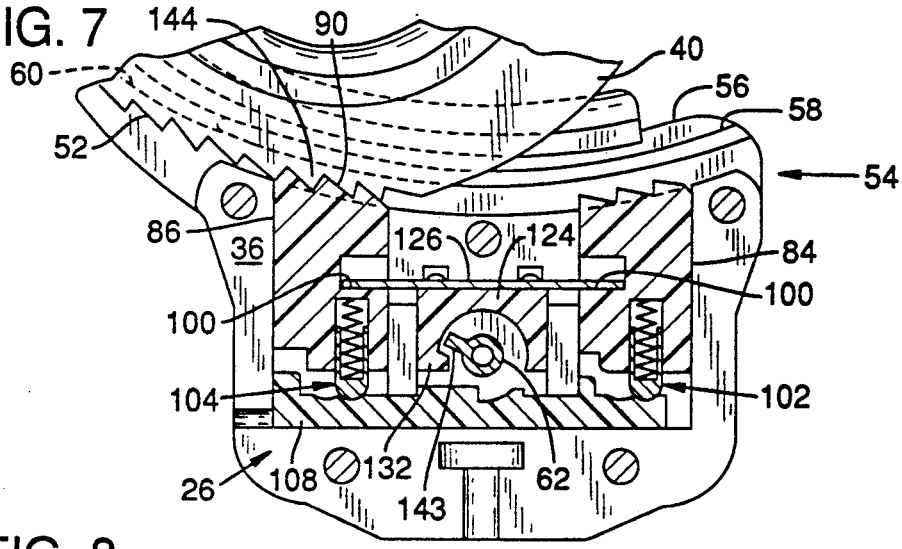
FIG. 7 is similar to FIG. 4, except that the left single-locked state of the exemplary lock assembly is shown.

If the wrist of the suspect is of very small size, the blade 40 will advance beyond its double-locked position 142, shown in FIG. 5, to a left single-locked position 144 in close engagement with the fingers 90 of only the left plunger 86, as shown in FIG. 7. This left single-locked position 144 is closely analogous to the right single-locked position 138 shown in FIG. 5 and has corresponding attributes to those already described in connection with that position. It will be recognized that regardless of whether the blade 40 is in right single-locked position 138, in double-locked position 142, or in left single-locked position 144, added protection against tampering can be obtained by shifting the slide 108 to its deadlocking position as explained below and shown in FIG. 6.

Comparing now FIGS. 5 and 6, as an added measure of protection against tampering, the blade 40 of the exemplary lock assembly 26 can be triple-locked into position. This is done by inserting an external rod-like probe, carried by the officer for this purpose, into the opening 122 and pushing against the driving end 120 of the slide 108 with such probe until the slide shifts to its deadlocked position shown in FIG. 6. In this position, the spaced-apart pair of raised shoulders 114A and 114B of the slide 108 abut the stepped lower ends 92 of the right and left plungers 84 and 86, thereby immobilizing both plungers inside the channel so that the blade 40 is prevented from moving in either direction. Therefore, in addition to added security, this triple-locking feature can be used to prevent overtightening of the handcuff. To return the exemplary locking assembly 26 to its double-locked condition, the primary key 62 is inserted in the keyhole and rotated in a clockwise direction as indicated in FIG. 6 until the tang 143 of the key catches the edge 118 of the dip 116 and drives the slide 108 back to its initial position shown in FIG. 5. Operation of the slide will triple lock (FIG. 6) the cuff when starting from the double locked position (FIG. 5) and double lock the cuff when starting from the right single-locked (FIG. 5) or left single-locked (FIG. 7) positions.

Figure 8:
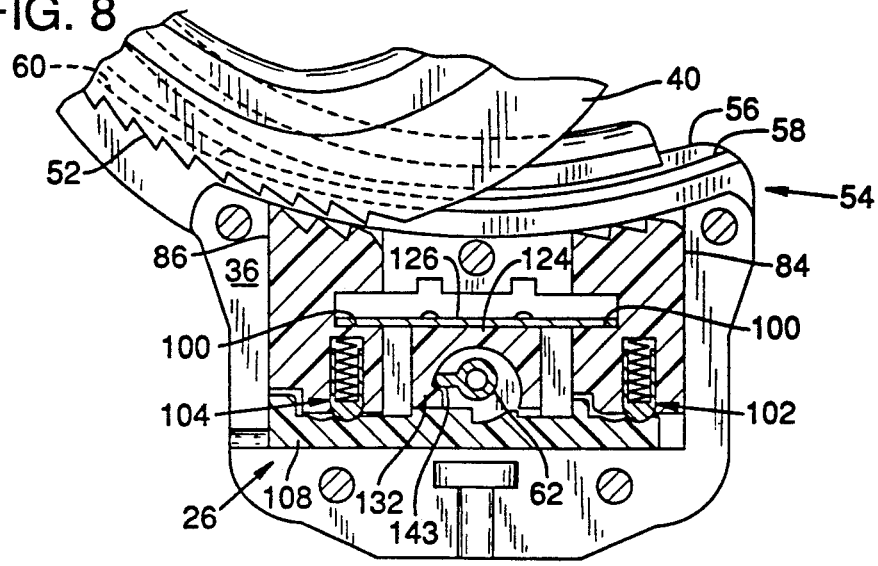
FIG. 8 is an enlarged view of the exemplary lock assembly of FIG. 3.

When it is desired to remove the handcuff from the suspect's wrist, the primary key 62 is inserted in the keyhole and rotated to its furthermost counterclockwise position as indicated in FIG. 8, whereupon the extractor block 124 is drawn to its unlocked position with its catch 132 pinned against the slide by the tang 143 of the key 62. The yoke 126, meanwhile, bears against the loading surface 100 of both plungers 84 and 86, and simultaneously draws both plungers, in coupled movement against their independent bias, out of the channel 54. The blade 40 can then be backed out of the channel in order to open the handcuff. After opening of the handcuff, release and removal of the key permits the return of the extractor block 124 to its normal locked position under the bias of the right and left spring elements 102 and 104.

Viewing FIGS. 2, 3, 5, and 7 together, the wide range of operation afforded by the exemplary locking assembly 26 can now be recognized. Whether the blade 40 and cheek plates 28 and 30 are configured to receive a large and rounded wrist (FIG. 2) or a small and flattened wrist (FIG. 3) there is a locked position for the blade (FIG. 5 or FIG. 7) corresponding to that configuration.

A related benefit afforded by the exemplary locking assembly 26 is a substantial increase in the number of possible locking positions over that provided by a conventional locking assembly. For example, in FIG. 2 the blade 40 has a series of 18 teeth 52. If this blade were to interact with a conventional locking assembly having a pawl with three fingers, no more than 20 unique locking positions would be possible (in the first locking position, the lead tooth 52A of the blade would abut the last finger of the pawl; in the twentieth locking position, the last tooth 52B of the blade would abut the lead finger of the pawl).

Referring now to FIG. 5, imagining, for a moment, that the right locking position occupied by the lead tooth 52A of the blade is occupied, instead, by the last tooth 52B (e.g., the blade is in its twentieth locking position), it will be recognized that there are an additional eight locking positions which are possible as a result of interaction between the left plunger 86 and the blade 40. (For example, in the twenty-eighth locking position, the last tooth 52B of the blade abuts the lead finger 90A of the left plunger 86.) Accordingly, the exemplary handcuff 20 has an increased number of possible settings.

In summary, the spring assemblies 102 and 104, which respectively interact with the plungers 84 and 86 at the right and left ends of the channel, constitute first and second locking mechanisms, while the slide 108 acts as a third locking mechanism. Conversely, the operation of the key 61, in cooperation with the extractor block 124 and yoke 126, acts as means for unlocking the first and second locking mechanisms and, in cooperation with portions 116 and 118 of the slide 108, acts as means for unlocking the third locking mechanism.

Figure 9:
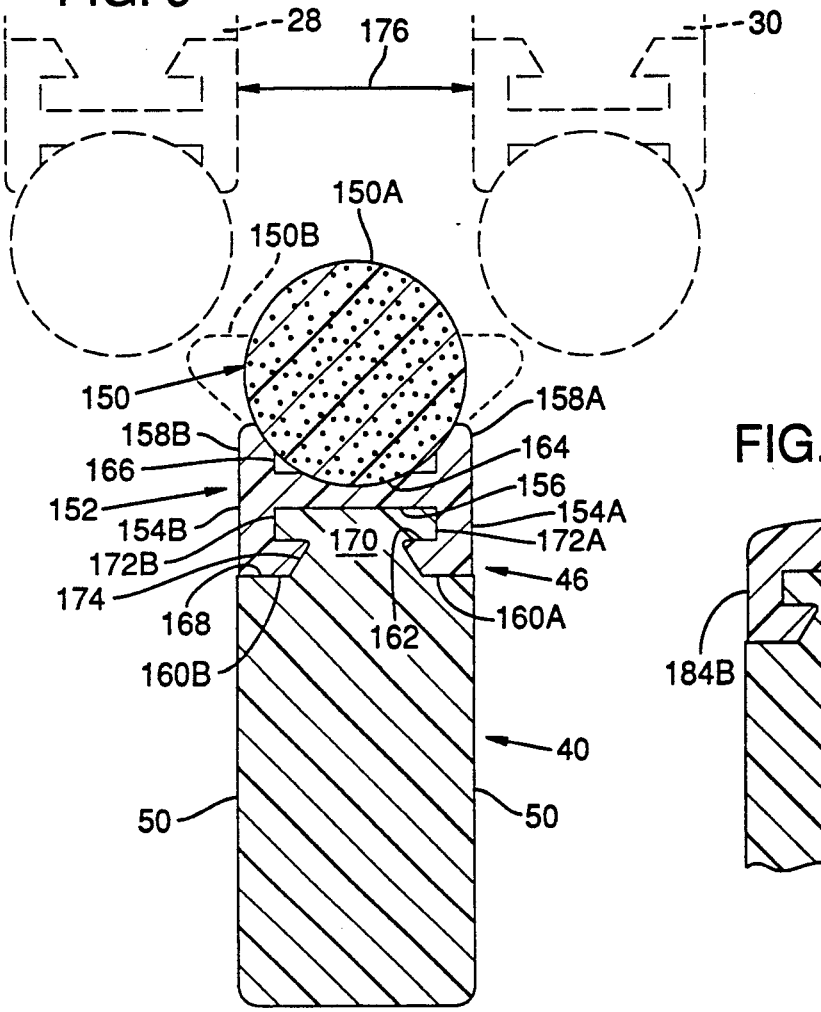
FIG. 9 is an enlarged sectional view, taken along lines 9—9 of FIG. 1, showing the cushion and exemplary fastening sleeve of the present invention, where alternate states of the cushion are depicted in dashed- and solid-line view, respectively, and where the cheek plates and their associated structures are shown in phantom-line view to show their arrangement relative to the blade and its associated structures.
Figure 10:
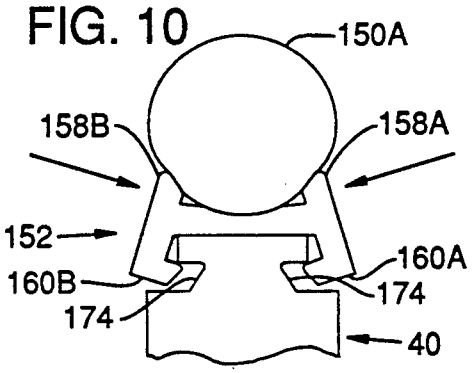
FIG. 10 is a schematic depiction of the attaching and removing functions of the exemplary fastener of FIG. 9.
Figure 11:
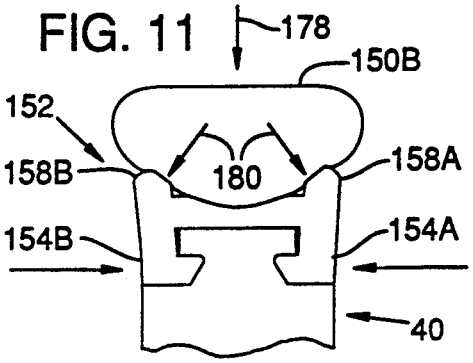
FIG. 11 is a schematic depiction of the forces developed during self-locking of the exemplary fastener of FIG. 9.

The present invention is also concerned with providing a speed cuff having a cushioned grip. Accordingly, as shown for the exemplary handcuff 20 depicted in FIGS. 1-3, a flexible elongate cushion 150 is arranged along the inner edge 46 of, respectively, the blade 40, the forwardmost cheek plate 28, and the rearwardmost cheek plate 30. In one embodiment an elongate semi-rigid fastening sleeve 152 is used to detachably hold each cushion 150 in place. The sleeve 152, the cushion 150, and certain modifications that are made to the respective inner edges 46 of the blade and cheek plates will now be described with reference to FIGS. 9-11, FIG. 9 showing an enlarged sectional view taken through the blade 40 along lines 9-9 of the handcuff shown in FIG. 2. Although not separately discussed, each of the cheek plates 28 and 30 has associated cushioning structures similar to that of the blade, as indicated by the phantom-line representation of these members in FIG. 9.

Referring to FIG. 9, the sleeve 152 is generally H-shaped in cross-section, having a lower portion including a spaced-apart pair of lower legs 154A and 154B, a central cross member 156, and an upper portion including a spaced-apart pair of upper legs 158A and 158B. The material forming the sleeve is sufficiently stiff to permit pincer-type operation, that is, urging of the upper legs 158A and 158B together serves to urge the lower legs 154A and 154B apart as shown in FIG. 10. Extending inwardly from the ends of the lower legs 154A and 154B are, respectively, right and left feet 160A and 160B. Each foot defines a retaining surface 162 facing the central cross-member 156. In the upper portion of the sleeve 152, the pair of upper legs 158A and 158B and central cross-member 156 together define an elongate, generally rounded bed 164. A spaced-apart pair of notches 166 configure the bed 164 in such a manner that the sleeve has a substantially uniform thickness in cross section enabling it to be fabricated by a relatively inexpensive extrusion process. Preferably, the sleeve is formed of a polyester elastomeric material such as HYTREL TM made by E. I. duPont deNemours. Other materials being generally designated as thermoplastic elastomers may also perform suitably for this purpose. The substantially uniform thickness of the sleeve promotes even cooling of the sleeve material during extrusion and reduces warping of the sleeve 152 after cool-down.

As shown in FIG. 9, the rounded bed 164 of the sleeve 152 is suitably shaped for receiving the cushion 150. A preferred material for the cushion 150 is closed-cell, self-skinned neoprene generally available in cord-like form under the trade name RUBATEX TM made by Rubatex Corporation. After these cords have been cut to an appropriate length for arrangement along the inner edges of the handcuff, the ends of each cord, or the entire cord, can be dipped in a lacquer or the like to seal or color code them (e.g., the color blue may be used to indicate a relatively dense cushion and white a lighter cushion). The cushion 150 is desirably bonded within the bed 164 of the sleeve 152 by a permanent adhesive (not shown). The attachment step is facilitated by the notches 166 which prevent excessive seepage of adhesive from the bed 154 when the cushion 150 and sleeve 152 are pressed together for bonding.

As shown in FIG. 9, the inner edge 46 of the blade 40 (and cheek plates) has been modified in order to establish a secure yet detachable connection with the sleeve 152. In particular, the modified inner edge 46, in cross-sectional profile, defines a lower bank 168 out of which rises a T-shaped ridge. Comprising the T-shaped ridge is a stem 170 that extends substantially parallel to the sides 50 of the blade and a pair of right and left arms, 172A and 172B, which extend perpendicularly from the top of the stem 170 in inwardly-offset relation from the sides 50. Together, the stem 170 and each respective arm, 172A or 172B, define a pair of elongate grooves 174 in the blade perpendicular to the sides 50.

As already described, the blade, and cheek plates as well, are preferably molded of a lightweight polymeric material. Despite its complex profile, the blade 40 can be easily withdrawn from its mold due to the positive draft of the inner edge 46. That is, when the time comes to divide the mold along a plane lying between the sides 50 of the blade, no backwardly curved structure exists on the inner edge 46 which would catch on the molds and prevent their separation.

The cushion 150 and sleeve 152 subassembly is conveniently attached to the inner edge 46 of the blade 40 by pinching the upper legs 158A and 158B together, as indicated in FIG. 10, and then releasing the upper legs so as to permit the right and left foot 160A and 160B of the fastener to latch within the grooves 174 of the inner edge for a secure fit.

Referring to FIG. 9, in accordance with the invention, the actual size of material used to form the cushion 150 is selected on the basis of certain dimensions of the handcuff. To begin with, because the described preferred material has a resilient property, the cushion 150 will be capable of alternately assuming a first relatively narrow profile 150A, in cross-section, when unloaded, and a second relatively wide profile 150B, in cross-section, when so loaded as to bear with moderate force upon the suspect's wrist. In accordance with the present invention, then, the size of material selected to form the cushion is such that the cushion, while assuming its first profile 150A, passes smoothly through the gap 176 defined between the cheek plates 28 and 30, and, while assuming its second profile 150B, is incapable of passing through the gap 176. Such selection ensures the smooth operation of the exemplary handcuff 20 while, at the same time, takes maximum advantage of the cushion grip feature.

In particular, because the cushion 150, when assuming its second profile 150B, widens the area of engagement with the suspect's wrist over that otherwise available along the inner edge 46 of the blade 40, the suspect's wrist is held more securely. At the same time, there is less likelihood that the suspect's wrist will be injured from overtightening the handcuff, because the cushion 150 distributes the tightening force imposed by the officer over a substantially wider area. Moreover, when experiencing long-term loading, the described preferred material for the cushion 150 tends to lose some of its shorter-term "springiness" and to yieldably relax somewhat, therefore also reducing the risk of limb injury. Further adding to security of the exemplary handcuff 20 is the full wraparound affect achieved by the cushion 150, so that whether the suspect's wrist is round or flattened the cushion 150 conforms closely to the wrist over more of the circumference of the wrist.

Referring again to FIG. 9, the particular construction of the sleeve 152 and the modifications made to the inner edge 46 of the blade 40, cooperate together to prevent unauthorized removal of the cushion 150 from the handcuff. In particular, because the right and left arms 172A and 172B are inwardly offset from the sides 50 of the blade 40, the right and left lower legs 154A and 154B of the sleeve sits flush with these sides. There is no surface available, then, against which the fettered suspect can work a tool to pry the sleeve 152 loose. Moreover, as depicted in FIG. 11, the exemplary fastener 152 is inherently self-locking when loaded, for as the cushion 150 bears with increasing force 178 against the wrist, the feet 160A and 160B of the sleeve are increasingly forced into the grooves 174 of the blade.

Referring to FIG. 10, the cushion 150 and sleeve 152 subassembly is conveniently removed from the blade 40 by pinching together the upper legs 158A and 158B of the sleeve and lifting the sleeve away. Together with the above-described convenient attachment procedure, then, this operation permits easy removal and replacement of the cushion should the cushion become contaminated with bodily fluids through use. Alternatively, the cushion 150 and sleeve 152 subassembly can be removed for separate autoclaving and then reinserted on the blade.

Figure 12:
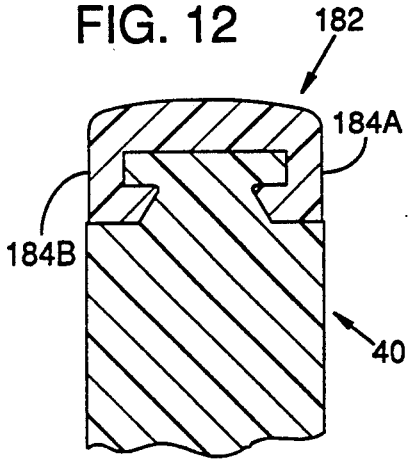
FIG. 12 is similar to FIG. 9, except that the blade, shown in view, carries an alternative type of fastening sleeve with integral cushioning.

Referring now to FIG. 12, an alternative type of fastener 18 is shown which provides enhanced security but at a reduced level of comfort. The alternative sleeve 182 is made of a tough elastomeric material that will resist penetration by a pointed tool yet provides some measure of cushioning effect. As with the exemplary sleeve 152 shown in FIG. 8, the lower legs 184A and 184B of the alternative sleeve are arranged to sit flush with the sides of the blade to prevent unauthorized removal.

While a preferred embodiment of the invention has been described, it will be recognized that alternative forms of the invention are possible within the broader principles of the present invention. For example, instead of having plungers 84 and 86 which operate in separate channels, the locking assembly 26 may include diverging pawl members which share a common pivot. Nor is it absolutely essential for operation that each plunger have a series of fingers 88 or 90 or a loading surface 100 located within a recess 98. One or more leaf springs could be substituted for the coil springs. Furthermore, operation of the two spring elements 102 and 104 and triple-locking slide 108 may be combined.

Regarding the cushion 150, different structures will provide a resilient cushioning effect including, for example, fluid-filled bladders. Regarding the sleeve 152, a single foot on one of the pair of lower legs 154A and 154B would suffice to latch the fastener to the inner edge 46 of the blade 40. It is further conceivable that several consecutive fasteners could be used, instead of one elongate fastener, to fasten on one cushion 150, although the gaps between such fasteners would encourage tampering.

The terms and expressions which have been employed in the foregoing specification are used therein as terms of description and not of limitation, and there is no intention, in use of such terms and expressions, of excluding equivalents of the features shown and described or portions thereof, it being recognized that the scope of the invention is defined and limited only by the claims which follow.

What is claimed is:

1. An improved handcuff for encircling a subject's limb having a casing; an arcuate blade; a pair of opposed spaced-apart arcuate cheek plates each having a first end fixably connected to said casing and a second end pivotably connecting said blade such that said blade is rotatable 360° around said second end of said cheek plates and between said cheek plates; wherein said casing defines an elongate channel, said blade defining a series of teeth movable through said channel as said blade rotates about said second end of said cheek plates, comprising:

(a) first and second pawl members respectively including first and second fingers extending into said channel for engaging said teeth;

(b) first and second locking means for respectively resiliently urging said first and second pawl members toward and yieldably permitting movement away from said channel independently of one another; and (c) said channel including an entrance and an exit, said first and second fingers being spaced apart from each other in said channel with one proximate said entrance and one proximate said exit.

2. The handcuff of claim 1, further including third locking means, operatively associated with said first and second pawl members, for selectively simultaneously preventing said first and second pawl members from moving away from said channel.

3. The handcuff of claim 1, including first unlocking means, operatively associated with both said first and second pawl members, for selectively simultaneously moving said first and second pawl members away from said channel when said handcuff encircles a subject's limb.

4. The handcuff of claim 2, including second unlocking means for selectively overcoming said third locking means and permitting said first and second pawl members to be simultaneously moved away from said channel.

5. An improved handcuff for encircling a subject's limb having a casing; an arcuate blade; a pair of opposed spaced-apart arcuate cheek plates each having a first end fixably connected to said casing and a second end pivotably connecting said blade such that said blade is rotatable 360° around said second end of said cheek plates and between said cheek plates; wherein said casing defines an elongate channel, said blade defining a series of teeth movable through said channel as said blade rotates about said second end of said cheek plates, comprising:

(a) first and second pawl members respectively including first and second fingers extending into said channel for engaging said teeth;

(b) first and second locking means for respectively resiliently urging said first and second pawl members toward and yieldably permitting movement away from said channel independently of one another; and (c) said casing including a right and left edge, said casing defining a first and second chamber both opening to said channel and extending, respectively, alongside said right and left edge, said first and second pawl members, respectively, including first and second plungers slidably disposed in said first and second chambers.

6. The handcuff of claim 1 wherein said first and second locking means respectively include a pair of first and second separate spring elements.

7. An improved handcuff having a casing; an arcuate blade; and a pair of opposed arcuate cheek plates spaced-apart to define a gap therebetween, each cheek plate having a first end fixably connected to said casing and a second end pivotably connecting said blade such that said blade is rotatable 360° around said second ends of said cheek plates and through said gap and cooperates with said cheek plates for closure about a subject's limb, said blade defining a generally concave inner edge, comprising:

(a) an elongate deformable cushion arranged along said inner edge of said blade, said cushion having a first profile, cross-section, capable of passing through said gap;

(b) said cushion including resiliently deformable means for enabling said cushion to assume a second profile, in cross-section, when bearing upon a limb, wider than said gap, and for causing said cushion to resume said first profile when not bearing upon a limb.

8. An improved handcuff having a casing; an arcuate blade; and a pair of opposed arcuate cheek plates spaced-apart to define a gap therebetween, each cheek plate having a first end fixably connected to said casing and a second end pivotably connecting said blade such that said blade is rotatable 360° around said second ends of said cheek plates and through said gap and cooperates with said cheek plates for closure about a subject's limb, said blade defining a generally concave inner edge, comprising:

(a) an elongate deformable cushion arranged along said inner edge of said blade, said cushion having a first profile, in cross-section, capable of passing through said gap;

(b) said cushion including resiliently deformable means for enabling said cushion to assume a second profile, in cross-section, when bearing upon a limb, incapable of passing through said gap, and for causing said cushion to resume said first profile when not bearing upon a limb; and (c) said blade including a pair of spaced-apart sides extending back from said inner edge, said cushion including an elongate sleeve having a lower portion adapted to detachably engage said inner edge of said blade such that said lower portion of said sleeve is substantially flush with said sides of said blade.

9. The handcuff of claim 8 wherein said inner edge of said blade, in cross-sectional profile, defines a lower bank and a T-shaped ridge raised from said lower bank, said T-shaped ridge including a stem substantially parallel to said sides and a pair of right and left arms extending perpendicularly from the top of said stem.

10. The handcuff of claim 9 wherein said arms of said T-shaped ridge are inwardly offset with respect to said sides of said blade.

11. The handcuff of claim 9 wherein said right and left arms respectively define a pair of right and left grooves between said arms and said lower bank.

12. The handcuff of claim 11 wherein said sleeve is substantially H-shaped in cross-section with a pair of spaced-apart upper and lower legs, said lower legs respectively including a pair of opposed, inwardly-facing right and left feet.

13. The handcuff of claim 12 wherein said right and left feet of said sleeve are received and retained in said right and left grooves of said blade.

14. The handcuff of claim 7 wherein said blade and cheek plates are molded of polymeric material.

15. The handcuff of claim 7 wherein said cheek plates each define a generally concave inner edge and further including second and third elongate deformable cushions each arranged along the inner edge of a respective one of said cheek plates.

16. An improved handcuff having a casing; an arcuate blade; a pair of opposed spaced-apart cheek plates each having a first end fixably connected to said casing and a second end pivotably connecting said blade such that said blade is rotatable 360° around said second ends of said cheek plates and between said cheek plates and cooperates with said cheek plates for closure about a subject's limb, said blade defining a generally concave inner edge, a generally convex outer edge; and a pair of spaced-apart sides extending between said inner and outer edges, comprising:

(a) an elongate cushion arranged along said inner edge of said blade;

(b) fastening means for detachably fastening said cushion to said inner edge of said blade while leaving the outer edge of said blade free of overlay; and (c) said fastening means including an elongate sleeve having a lower portion adapted to detachably engage said inner edge such that said lower portion of said sleeve is substantially flush with said sides of said blade.

17. An improved handcuff having a casing; an arcuate blade; a pair of opposed spaced-apart cheek plates each having a first end fixably connected to said casing and a second end pivotably connecting said blade such that said blade is rotatable 360° around said second ends of said cheek plates and between said cheek plates and cooperates with said cheek plates for closure about a subject's limb, said blade defining a generally concave inner edge, a generally convex outer edge; and a pair of spaced-apart sides extending between said inner and outer edges, comprising:

(a) an elongate cushion arranged along said inner edge of said blade;

(b) fastening means for detachably fastening said cushion to said inner edge of said blade while leaving the outer edge of said blade free of overlay; and (c) said fastening means including an elongate semi-flexible sleeve of substantially constant cross-section throughout its length.

18. An improved handcuff having a casing; an arcuate blade; a pair of opposed spaced-apart cheek plates each having a first end fixably connected to said casing and a second end pivotably connecting said blade such that said blade is rotatable 360° around said second ends of said cheek plates and between said cheek plates and cooperates with said cheek plates for closure about a subject's limb, said blade defining a generally concave inner edge, a generally convex outer edge; and a pair of spaced-apart sides extending between said inner and outer edges, comprising:

(a) an elongate cushion arranged along said inner edge of said blade;

(b) fastening means for detachably fastening said cushion to said inner edge of said blade while leaving the outer edge of said blade free of overlay; and (c) said inner edge of said blade defining an elongate groove inwardly recessed in a direction generally perpendicular to the sides of said blade.

19. The handcuff of claim 18 wherein said fastening means is substantially H-shaped in cross-section with a pair of spaced apart upper and lower legs, and a cross-member connecting each of said pair of said upper and lower legs, one of said lower legs including an inwardly facing foot adapted to be received in said groove in said blade.

20. The handcuff of claim 19 wherein said upper legs, when urged together, act as means for urging said lower legs apart.

21. The handcuff of claim 19 wherein said upper legs, when urged apart, act as means for urging said lower legs together and retaining said sleeve in attachment to said edge of said blade.

22. The handcuff of claim 3 wherein said first unlocking means is interposed between said first and second pawl members.

23. The handcuff of claim 5 further including third locking means, operatively associated with said first and second pawl members, for selectively simultaneously preventing said first and second pawl members from moving away from said channel.

24. The handcuff of claim 5, including first unlocking means, operatively associated with both said first and second pawl members, for selectively simultaneously moving said first and second pawl members away from said channel when said handcuff encircles a subject's limb.

25. The handcuff of claim 5, including second unlocking means for selectively overcoming said third locking means and permitting said first and second pawl members to be simultaneously moved away from said channel.

26. An improved handcuff for encircling a subject's limb having a casing; an arcuate blade; a pair of opposed spaced-apart arcuate cheek plates each having a first end fixably connected to said casing and a second end pivotably connecting said blade such that said blade is rotatable 360° around said second end of said cheek plates and between said cheek plates; wherein said casing defines an elongate channel, said blade defining a series of teeth movable through said channel as said blade rotates about said second end of said cheek plates, comprising:

(a) a spaced-apart pair of pawl members each having a finger extending into said channel for engaging said teeth;

(b) a guide located between said pawl members;

(c) an extractor selectively slidable along said guide away from said channel in response to manipulation by an external key; and (d) non-pivoting coupling means for coupling said extractor to each of said pair of pawl members so that movement of said extractor in a direction away from said channel draws said finger of each pawl member from said channel.

27. The handcuff of claim 26 wherein said coupling means includes a yoke carried on said extractor and having opposed ends, each end engaging a respective one of said pawl members.

28. The handcuff of claim 27 wherein each pawl member includes a recess for receiving a respective end of said yoke.

29. The handcuff of claim 26 wherein said guide includes a guide chamber defined in said casing and substantially surrounding said extractor.

30. The handcuff of claim 26 wherein said pawl members move substantially perpendicular to said channel and said coupling means includes an elongate yoke attached to said extractor and extending substantially parallel to said channel.

31. An improved handcuff for encircling a subject's limb having a casing; an arcuate blade; a pair of opposed spaced-apart arcuate cheek plates each having a first end fixably connected to said casing and a second end pivotally connecting said blade such that said blade is rotatable 360° around said second end of said cheek plates and between said cheek plates; wherein said casing defines an elongate channel, said blade defining a series of teeth movable through said channel as said blade rotates about said second end of said cheek plates, comprising:

(a) a pair of spaced-apart resiliently biased pawl members for movably engaging said blade, said blade and said pair of pawl members each being molded of polymeric material; and (b) at least one of said blade and said pawl members including lubricating means other than said polymeric material for reducing the wear between said blade and each of said pair of pawl members when said pawl members movably engage said blade.

32. The handcuff of claim 31 wherein said lubricating means includes an additive combined with said polymeric material during molding of at least one of said blade and said pair of pawl members.

33. The handcuff of claim 32 wherein said additive contains fluorine.

* * * * *